US005152427A

United States Patent [19]

Pope et al.

[11] Patent Number: 5,152,427

[45] Date of Patent: Oct. 6, 1992

[54] FLUID PRODUCT DISPENSER WITH VOLUME INDICATOR

[75] Inventors: John M. Pope, St. Charles; James P. Coleman, Maryland Heights; John H. Wagenknecht, Cedar Hill, all of Mo.

[73] Assignee: Monsanto Company, St. Louis, Mo.

[21] Appl. No.: 693,849

[22] Filed: Apr. 30, 1991

[51] Int. Cl.[5] ..... B67D 5/06

[52] U.S. Cl. ..... 222/23; 222/106; 222/386.5; 116/200; 116/278; 116/307

[58] Field of Search ..... 222/23, 45, 47, 94, 222/95, 106, 158, 386.5, 209, 212; 116/200, 278, 307, DIG. 1

[56] References Cited

U.S. PATENT DOCUMENTS

| | | | |
|---|---|---|---|
| 2,608,320 | 8/1952 | Harison, Jr. | 222/95 |
| 3,185,345 | 5/1965 | Hunegs | 222/45 |
| 3,240,399 | 3/1966 | Frandeen | 222/211 |
| 3,443,724 | 5/1969 | Boston | 222/45 X |
| 3,529,832 | 11/1950 | Brietzke | 116/278 |
| 3,656,660 | 4/1972 | Mueller | 222/94 |
| 4,020,978 | 5/1977 | Szczepanski | 222/209 |
| 4,098,434 | 7/1978 | Uhlig | 222/94 |
| 4,159,790 | 7/1979 | Bailey | 222/211 |
| 4,322,020 | 3/1982 | Stone | 222/95 |
| 4,408,702 | 10/1983 | Horvath | 222/212 |
| 4,465,290 | 8/1984 | Hooley | 116/200 X |
| 4,469,250 | 9/1984 | Evezich | 222/83 |
| 4,770,937 | 8/1988 | Evezich | 222/95 |
| 4,782,983 | 11/1988 | Cook | 222/45 |
| 4,809,884 | 3/1989 | Stackhouse | 222/153 |
| 4,842,165 | 6/1989 | Van Coney | 222/212 X |
| 4,865,224 | 9/1989 | Streck | 222/95 |
| 4,909,416 | 3/1990 | Evezich | 222/95 |
| 4,948,016 | 8/1990 | Summons et al. | 222/158 |
| 5,033,647 | 7/1991 | Smith et al. | 222/212 X |

*Primary Examiner*—Gregory L. Huson

*Attorney, Agent, or Firm*—Thomas E. Kelley; Richard H. Shear

[57] ABSTRACT

A non-transparent, fluid product dispenser comprising a structurally rigid outer container and a flexible inner container provided with means for visually indicating the amount of product remaining in the dispenser comprising a mechanical actuator attached between the end of the liner container and an actuatable indicator on the outer container. Operating in proportion to the travel of the end of the inner container, the actuator is connected to at least one pull tab attached to an indicator window in the outer container.

1 Claim, 2 Drawing Sheets

FLUID PRODUCT DISPENSER WITH VOLUME INDICATOR

Disclosed herein are fluid product dispensers comprising visually opaque containers having visual indicators responsive to the contents of the dispenser remaining in the dispenser. Such visual indicators include color change of the dispensed contents and color change of an indicator panel on the dispenser.

BACKGROUND OF THE INVENTION

Common dispensers for certain viscous fluid products, e.g. pastes such as toothpaste, cheese, and the like, include rigid containers having pump mechanisms for delivering the product. A variety of means have been utilized to provide an indication of remaining product volume in such containers. For instance, in certain dispensers the rigid walls are transparent. In other cases the bottom of the dispenser comprises a movable piston-like plate which is sealed to the inner wall of dispenser and advances toward the delivery end of the dispenser as the product is delivered. Because the product is contained within a rigid container, an inherent disadvantage of such dispensers is that a residual volume of product cannot be removed from the dispenser and is therefor wasted. To improve the economics of providing products in such dispensers, it has been suggested that the product be provided in a flexible inner container, e.g. a plastic bag, within a rigid outer container having a fixed bottom and non-transparent side walls. A disadvantage of such containers is a lack of visual indicator or remaining volume in the dispenser. For instance, an indication that one-half, three-quarters or so of the contents have been consumed would be especially useful to allow timely replenishment with a new dispenser.

SUMMARY OF THE INVENTION

This invention provides visual indicia of the amount of product remaining in a non-transparent fluid product dispenser which comprises a structurally rigid outer container and a collapsible inner container having the fluid product therein. Such dispensers also comprise an outlet for delivering the product and means for transferring the product from the collapsible inner container to the outlet, e.g. a pump mechanism. Even though the dispenser is sufficiently opaque to inhibit visual indication of the amount of product remaining in the dispenser, the visual indicia provided by this invention allows a readily readable indication of the approximate volume remaining in the dispenser.

DETAILED DESCRIPTION OF PREFERRED EMBODIMENTS

Figure 1:
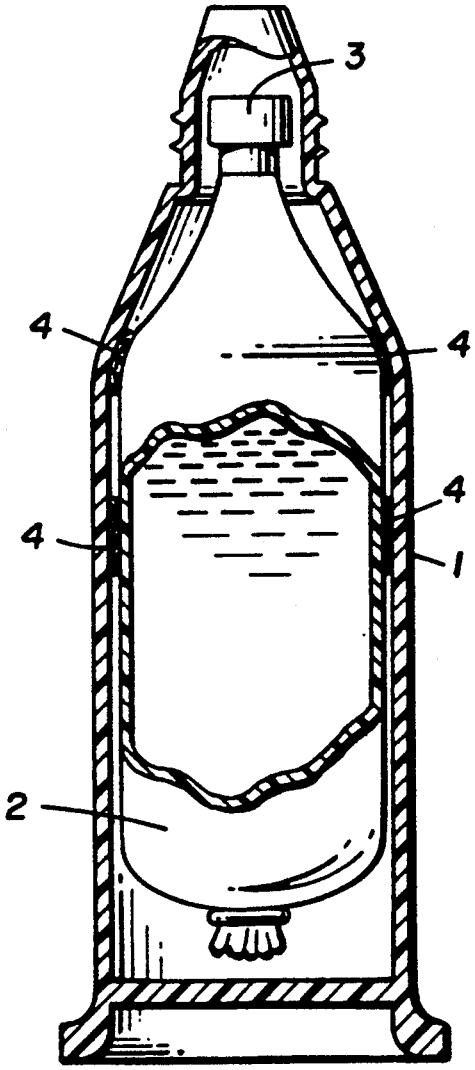
FIGS. 1 and 2 are partial cutaway views illustrating the construction of dispensers useful in this invention.
Figure 2:
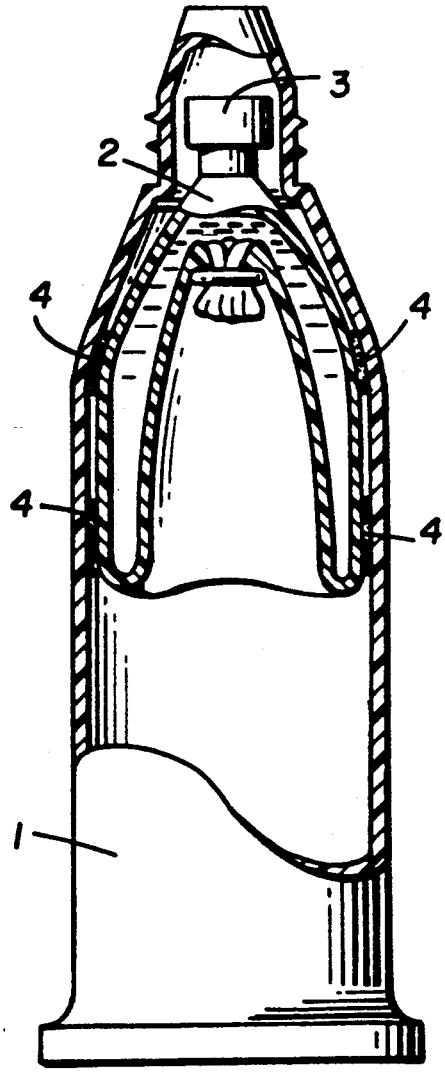

With reference to the drawings, there is shown in partial cutaway views fluid product dispensers comprising a structurally rigid outer container 1, a flexible inner container 2 having a fluid product therein, an outlet (not shown) for delivering the product, and means 3, e.g. a pump mechanism, for transferring the product from the flexible inner container to the outlet. In FIG. 1 the dispenser is full as indicated by the inflated flexible inner container; and in FIG. 2 the dispenser is substantially empty as indicated by the deflated flexible inner container.

As product is dispensed from the flexible inner container there is a tendency for the walls of the flexible inner container to collapse inward creating choke points which make it difficult to dispense product from the lower regions of the inner container. Such side wall collapse can be averted by adhering the contact surfaces of the inner container and the outer container in the upper regions of the container, e.g. in the half of the container proximate to the outlet. Thus, as further indicated in FIG. 2, in the region of upper section of the flexible inner container, a sufficient amount of the outer surface of the flexible inner container is adhered to the inner surface of the rigid outer container at areas 4 to allow the lower half of the flexible inner container to collapse into the volume of the upper half of the flexible inner container thus allowing more complete delivery of product.

Such rigid outer container is typically cylindrical with a circular, oval, rectangular, or other fanciful cross section. The outer container can preferably be fabricated from rigid engineering thermoplastic such as polystyrene, polyethylene, polyvinylchloride, etc. The flexible inner container will be in the form of a bag and can be fabricated from polyethylene. The flexible inner container will preferably have a cross section generally conforming to the cross section of the outer container to facilitate adhesion between the inner and outer containers. Such adhesion can be effected by application of appropriate amounts of an adhesive, cement or solvent between the containers.

When the product is a high viscosity paste that is resistant to mixing, it has been found that the product located proximate to the end of the flexible inner bag is the last of the product to be dispensed prior to emptying the dispenser. One aspect of the visual indicator of product remaining in the dispenser is advantageously provided by including (or omitting) a dye in the product located proximate to the end of the flexible inner container. Thus, when the dispenser is used, a change in color of the product affords a visual indication that the dispenser will soon be empty. Such mix-resistant paste will typically have a viscosity of at least about 300 centipoises and may include toothpaste, cheese, cookie dough, bearing grease, and pastes of like mix-resistant viscosity.

Figure 3:
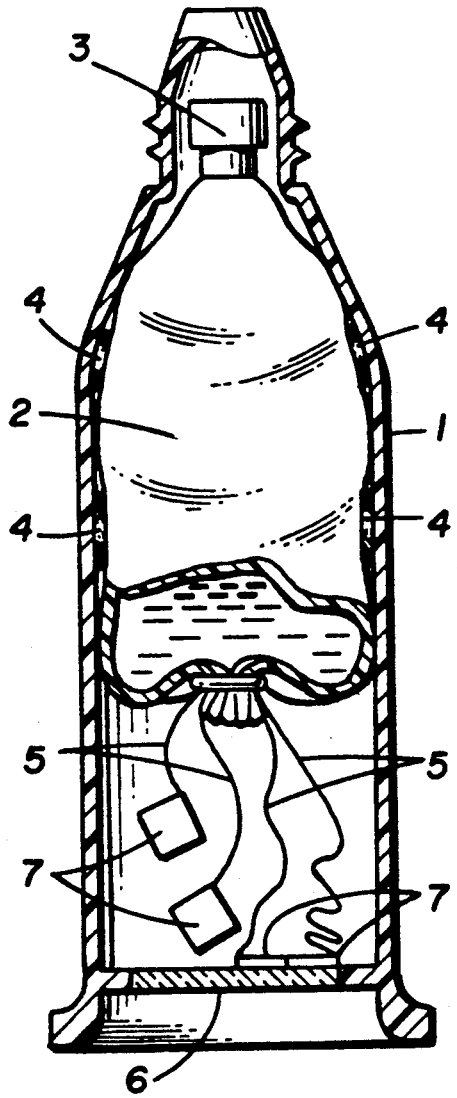
FIG. 3 is a partial cutaway view illustrating the operation of one aspect of this invention which provides indicia of the contents of a dispenser.
Figure 4:
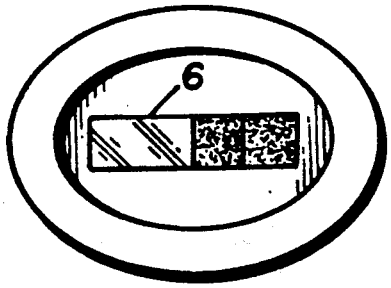
FIG. 4 is a bottom view of the dispenser of FIG. 3 showing a viewing window for the volume indicia.

In another aspect of this invention as illustrated in FIG. 3 the visual indicator can be provided by having a mechanical actuator attached between the end of said inner container and an actuatable indicator on the outer container where the actuator operates in proportion to the travel of said end of the inner container towards said outlet. Such mechanical actuator can comprise tension members 5 such as strings, cords, or tapes. The actuatable indicator can comprise a transparent window 6 located on the bottom of the dispenser or preferably on the lower side of the dispenser. In one aspect of this invention such window can be covered on the inside of the container with one or more pull tapes 7 which, when removed from the inside of the widow by the pulling of a tension member, will provide indicia of the contents of the dispenser. For instance, as product is dispensed the bottom of the flexible inner container will move upwards towards the outlet. The linear motion of the bottom can be readily determined as a function of percentage of available product dispensed. The length of a tension member between the bottom of the inner container and the pull tape on a window can be set so that, in response to volume dispensed, the pull tape can be removed to expose an indicia of the approximate volume remaining in the dispenser.

While specific embodiments have been described herein, it should be apparent to those skilled in the art that various modifications thereof can be made without departing from the true spirit and scope of the invention. Accordingly, it is intended that the following claims cover all such modifications within the full inventive concept.

What is claimed is:

1. A non-transparent, fluid product dispenser comprising a structurally rigid outer container, a flexible inner container having a fluid product therein, an outlet for delivering said product from said dispenser, means for transferring said product from said flexible inner container to said outlet, and means for providing a visual indicia of the amount of said product remaining in the dispenser; wherein at least about the half of the outer surface of said flexible inner container which is more proximate to said outlet is adhered to the inner surface of said outer container; and wherein said means for providing visual indicia comprises a mechanical actuator attached between the end of said inner container and an actuatable indicator on said outer container wherein said actuator operates in proportion to the travel of said end of the inner container towards said outlet, wherein said actuatable indicator comprises at least one pull tab attached to an indicator window in said outer container.

* * * * *